US009034118B2

(12) United States Patent
Fukushima et al.

(10) Patent No.: US 9,034,118 B2
(45) Date of Patent: May 19, 2015

(54) METHOD FOR MANUFACTURING HOT-ROLLED SHEET HAVING FINE-GRAINED FERRITE, AND HOT-ROLLED SHEET

(71) Applicant: Nippon Steel & Sumitomo Metal Corporation, Tokyo (JP)

(72) Inventors: Suguhiro Fukushima, Osaka (JP); Manabu Eto, Osaka (JP); Tamotsu Sasaki, Osaka (JP); Kaori Kawano, Osaka (JP); Masayuki Wakita, Osaka (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 129 days.

(21) Appl. No.: 13/792,458

(22) Filed: Mar. 11, 2013

(65) Prior Publication Data

US 2014/0086787 A1 Mar. 27, 2014

Related U.S. Application Data

(62) Division of application No. 12/525,094, filed as application No. PCT/JP2007/051765 on Feb. 2, 2007, now Pat. No. 8,404,060.

(51) Int. Cl.

| | |
|---|---|
| ***C22C 38/00*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| *B21B 1/38* | (2006.01) |
| *B21B 3/00* | (2006.01) |

(52) U.S. Cl.

CPC . *C22C 38/06* (2013.01); *B21B 1/38* (2013.01); *B21B 3/00* (2013.01); *C21D 8/02* (2013.01); *C22C 38/001* (2013.01); *C22C 38/02* (2013.01); *C22C 38/04* (2013.01)

(58) Field of Classification Search

USPC ..... 148/320, 645, 337
IPC ..... C22C 38/02,38/04; C21D 2211/005, C21D 8/0226, 9/46

See application file for complete search history.

(56) References Cited

FOREIGN PATENT DOCUMENTS

| | | |
|---|---|---|
| JP | 58-123823 | 7/1983 |
| JP | 59-229413 | 12/1984 |
| JP | 11-92859 | 4/1999 |

(Continued)

OTHER PUBLICATIONS

S. Fukushima et al., "Development of Super Short Interval Multi Pass Rolling Technology for Ultrafine-Grained Hot Strip", *Advanced Technology of Plasticity* (2005) Proceedings of the 8th ICTP, Oct. 9-13, 2005, Verona, Italy, p. 531-532.

(Continued)

*Primary Examiner* — Weiping Zhu
(74) *Attorney, Agent, or Firm* — Clark & Brody

(57) ABSTRACT

A method for manufacturing a hot-rolled sheet attains grain refinement of the steel sheet whose grain size is extremely fine. In particular, a ferrite grain size of less than average 2 μm is obtained, which is not laminar but has ferrite grains with equiaxed morphology and exhibits high formability in forming. The method comprises the steps of rolling and cooling, wherein the rolling reductions, cooling steps, and temperature are closely regulated. A hot rolled sheet made from the method of manufacturing has a controlled ferrite grain in different regions of sheet thickness.

1 Claim, 4 Drawing Sheets

(56) References Cited

FOREIGN PATENT DOCUMENTS

| | | |
|---|---|---|
| JP | 2001-234242 | 8/2001 |
| JP | 2002-69534 | 3/2002 |
| JP | 2004-136321 | 5/2004 |
| JP | 2004-137565 | 5/2004 |
| JP | 2004-143503 | 5/2004 |
| JP | 2005-213595 | 8/2005 |
| JP | 2005-226123 | 8/2005 |
| JP | 2005-305454 | 11/2005 |
| JP | 2006-341274 | 12/2006 |
| JP | 2006-342387 | 12/2006 |
| JP | 2006-348353 | 12/2006 |

OTHER PUBLICATIONS

K. Miyata et al., "Super Short Interval Multi-pass Rolling Technology for Manufacturing Ultrafine-grained Steel Sheet", Developments in Sheet Products for Automotive Applications; *Materials Science & Technology* 2005, p. 55-64.

M. Wakita et al., "Super Short Interval Multi-pass Rolling Technology for Manufacturing Ultrafine-grained Steel Sheet", The Joint International Conference of HSLA Steels 2005 and ISUGS 2005 Proceedings (ISUGS), *Iron & Steel Supplement* 2005 vol. 40, p. 112-115.

T. Tomida et al., "Effect of Ultra-Fast Cooling After Rolling in Stable Austenite Region on Grain Refinement of C—Mn Steel", *Materials Science Forum* vols. 539-543, p. 4708-4713, Copyright 2007.

K. Miyata et al., "Ultrafine Grained Steels Due to Super Short Interval Multi-Pass Rolling in Stable Austenite Region", *Materials Science Forum* vols. 539-543, p. 4698-4703, Copyright 2007.

M. Eto et al., "Development of super short interval multi-pass rolling technology for ultra fine-grained hot strip", *Rev. Met. Paris* No. 7-8 (Jul.-Aug. 2006), p. 319-325.

Eto et al., "Development of Super Short interval Multi-Pass Rolling Technology for Ultra Fine-Grained Hot Strip" , Rev. Met. Paris, 103-7-8 (Jul.-Aug. 2006), pp. 319-325.

Manufacturing method S1

METHOD FOR MANUFACTURING HOT-ROLLED SHEET HAVING FINE-GRAINED FERRITE, AND HOT-ROLLED SHEET

This application is a Divisional of U.S. Ser. No. 12/525,094 filed on Jul. 30, 2009, which is a national phase of PCT/JP2007/051765 filed on Feb. 2, 2007, which is published as WO/2008/096394 on Aug. 14, 2008.

TECHNICAL FIELD

The present invention relates to a method for manufacturing hot-rolled sheet to make ferrite grain size of a carbon steel finer and relates to the hot-rolled sheet.

BACKGROUND ART

It is known that refinement of ferrite grain enhances strength and ductility of the steel products, a method for manufacturing a hot-rolled sheet having fine-grained ferrite has been an important art to develop function of the steel materials. In addition, since refinement of ferrite grain can enhance strength of the steel products without using specific (micro-alloying) elements, recycling rate of the products is high and burden over the global environment is less.

As a method for obtaining a hot-rolled sheet having the fine-grained ferrite, conventionally, large-strain deformation has been studied. For example, Patent document 1 discloses that high-strength hot-rolled sheet having fine-grained ferrite of carbon steel, whose grain size is 3 to 5 μm, can be obtained by single pass or under an accumulated large reduction at phase-transformation temperature region.

Moreover, Patent document 2 discloses that a fine-grained ferrite whose grain size is about 2-3 μm can be obtained by giving reduction at a rolling reduction of 40% or more within the temperature range of 650-950 degree C. and again giving continuous reduction within two seconds at a rolling reduction of 40% or more.

It is understood that these methods utilize a grain refinement mechanism with ferrite transformation and ferrite recrystallization during rolling.

Patent Document 1: Japanese Patent Application Laid-Open (JP-A) No. 58-123823

Patent Document 2: JP-A No. 59-229413

DISCLOSURE OF THE INVENTION

Problems to be Solved by the Invention

By the methods shown in the above publications, grain size of about 2-3 μm is the limit of grain refinement. When the rolling temperature is set low for the purpose of further grain refinement, the ferrite becomes a laminar deformed texture stretched in the rolling direction; which results in a problem of deterioration in formability of the steel materials during the secondary processing (hereinafter, refer to as "forming"). Accordingly, an object of the present invention is to provide a method for manufacturing a hot-rolled sheet which attains grain refinement of the steel sheet whose grain size is finer than ever before, in particular, the ferrite grain size of less than average 2 μm, and which is not a laminar but has ferrite grains with equiaxed morphology and exhibits high formability in forming.

Further, by the conventional arts, cause of ferrite grain-size distribution attributed to the nonuniformity of strain in the thickness direction caused by the large reduction rolling is inevitable; thereby uniform formability is deteriorated in forming. The present invention provides a method for manufacturing a hot-rolled sheet, wherein the method attains grain refinement of the steel sheet in which the grain size thereof is set to particularly below average of 2 μm, which has ferrite grain with equiaxed morphology, which has high formability in forming, and the ferrite grain-size deviation in the thickness direction is uniformed down to the level not higher than a predetermined amount whereby uniform formability in forming is high. The present invention also provides a hot-rolled sheet obtained by the method.

Means for Solving the Problems

Hereinafter, the hot-rolled sheet of the present invention and the manufacturing method thereof will be described. In order to make the understanding of the present invention easier, reference numerals of the attached drawings are quoted in brackets; however, the present invention is not limited by the embodiment shown in the drawings.

As schematically shown in FIGS. 1 and 2, the method of the present invention is to obtain a hot-rolled sheet by treating a steel sheet having predetermined components at high temperature suitable for hot deformation, the method including: a first rolling (20) for rolling the sheet such that the total rolling reduction is 80% or more or the average grain size is 30 μm or less in a form of single phase of austenite; a second rolling (30) of a single-pass, a third rolling (40) being conducted thereafter; and a cooling (50) following to it.

The present inventors had carried out experiment using an experimental multi-pass hot-rolling mill (10) (See FIG. 3. The details will be described later) that enables to conduct large reduction rolling within a short-interpass time. As a result, they discovered the following effective conditions to obtain ultrafine grains. The inventors also discovered that grain refinement which is more excellent than ever before can be attained by suitably combining these conditions, and they completed the present invention. The conditions can be expressed in view of metallic crystal texture, as follows.

(1) The steel sheet has to be kept from ferrite transformation before the third rolling (40) as the last pass; an austenite before the ferrite transformation is refined as much as possible, then the dislocation density is raised.

(2) In the first rolling (20), the austenite has to be sufficiently microstructured and recrystallized.

(3) In the second rolling (30), while avoiding extra large reduction rolling which encourage the extremely rapid dynamic recrystallization/static recrystallization, rolling is carried out at a sufficient rolling reduction to accumulate strain for raising dislocation density.

(4) So as to minimize recrystallization and recovery of austenite and to enhance strain accumulation effect, interpass time between the second rolling (30) and the third rolling (40) as the last pass is required to be shorter than that of conventional rolling method and the temperature is set relatively low range including the supercooled austenite region.

(5) Even in the third rolling (40) as the last pass, rolling is conducted at a sufficient rolling reduction to accumulate strain for raising dislocation density. The exit side temperature at this time is set within a predetermined range.

(6) After the third rolling (40), the rolled sheet is immediately cooled (50) to facilitate ferrite transformation and to inhibit development of ferrite grains.

(7) When the third rolling (40) is carried out at least under a lubricated condition, it becomes possible to even out strain fluctuations in the thickness direction given by the rolling and possible to give more even strain to the sheet.

(8) When the third rolling (40) is carried out at least under a lubricated condition, temperature increase caused by high-pressure/high-speed rolling is inhibited, and strain accumulation effect can be enhanced.

(9) Even though considerable amount of strain given by the lubricated rolling is reduced; due to the effect in inhibiting temperature increase, effect of grain refinement can be maintained and improved.

Accordingly, the first aspect of the present invention solves the above problems by providing a method for manufacturing hot-rolled sheet, the method including: a step A including a first rolling (20) in which a steel sheet containing 0.04-0.20% C, 0.01-2.0% Si, 0.5-3.0% Mn by mass, and the reminder being Fe and inevitable impurities, is rolled by successive multi-pass rolling at a total rolling reduction of 80% or more while keeping the steel sheet at temperatures not lower than the para-equilibrium transformation temperature Ae3; a step B including a second rolling (30) in which a single-pass rolling is carried out at a rolling reduction of 30-55% when an entry side temperature is not lower than the para-equilibrium transformation temperature Ae3; a step C including a third rolling (40) in which a single-pass rolling is carried out at a rolling reduction of 35-70% when an entry side temperature is set within a predetermined range; and a step D in which within 0.2 seconds after the third rolling, the rolled sheet is cooled at a cooling rate of 600 degree C./sec or higher to a temperature not higher than {(the para-equilibrium transformation temperature Ae3)−130 degree C}, in the step C, the third rolling being carried out: within 0.6 seconds after the second rolling when the predetermined temperature range is {(the para-equilibrium transformation temperature Ae3)−60 degree C.} or more and below {(the para-equilibrium transformation temperature Ae3)−30 degree C}; within 0.5 seconds after the second rolling when the predetermined temperature range is {(the para-equilibrium transformation temperature Ae3)−30 degree C.} or more and below {(the para-equilibrium transformation temperature Ae3)−5 degree C}; and within 0.3 seconds after the second rolling when the predetermined temperature range is {(the para-equilibrium transformation temperature Ae3)−5 degree C.} or more and below {(the para-equilibrium transformation temperature Ae3)+20 degree C.}.

Here, "the para-equilibrium transformation temperature Ae3" means a thermal equilibrium temperature where the steel starts ferrite transformation from the temperature of austenite region.

The second aspect of the present invention solves the above problems by providing a method for manufacturing hot-rolled sheet, the method including: a step A' including a first rolling (20') in which a steel sheet containing 0.04-0.20% C, 0.01-2.0% Si, 0.5-3.0% Mn by mass, and the reminder being Fe and inevitable impurities, is rolled such that the texture just after rolling is a single phase of austenite having a grain size of 30 μm or less; a step B including a second rolling (30) in which a single-pass rolling is carried out at a rolling reduction of 30-55% when an entry side temperature is not lower than the para-equilibrium transformation temperature Ae3; a step C including a third rolling (40) in which a single-pass rolling is carried out at a rolling reduction of 35-70% when an entry side temperature is within the range of {(the para-equilibrium transformation temperature Ae3)−60 degree C.} or more and below {(the para-equilibrium transformation temperature Ae3)+20 degree C}; a step D in which within 0.2 seconds after the third rolling, the rolled sheet is cooled at a cooling rate of 600 degree C./sec or higher to a temperature not higher than {(the para-equilibrium transformation temperature Ae3)−130 degree C.}, in the third rolling, the third rolling being carried out: within 0.6 seconds after the second rolling when the entry side temperature range is {(the para-equilibrium transformation temperature Ae3)−60 degree C.} or more and below {(the para-equilibrium transformation temperature Ae3)−30 degree C}; within 0.5 seconds after the second rolling when the entry side temperature range is {(the para-equilibrium transformation temperature Ae3)−30 degree C.} or more and below {(the para-equilibrium transformation temperature Ae3)−5 degree C.}; and within 0.3 seconds after the second rolling when the entry side temperature range is {(the para-equilibrium transformation temperature Ae3)−5 degree C.} or more and below {(the para-equilibrium transformation temperature Ae3)+20 degree C.}.

The third aspect of the invention is the method for manufacturing hot-rolled sheet according to the second aspect of the invention, wherein the first rolling (20') is a successive multi-pass rolling and the total rolling reduction is: 65% or more when the entry side temperature of the first rolling is 850 degree C. or more and below 900 degree C.; 70% or more when the entry side temperature is 900 degree C. or more and below 950 degree C.; 75% or more when the entry side temperature is 950 degree C. or more and below 1000 degree C.; and 80% or more when the entry side temperature is 1000 degree C. or more.

The fourth aspect of the invention is the method for manufacturing hot-rolled sheet according to any one of the first to third aspects of the present invention, wherein the rolled sheet is cooled between the second rolling (30) and the third rolling (40) such that the entry side temperature of the third rolling (40) is {(the para-equilibrium transformation temperature Ae3)−60 degree C.} or more and below {(the para-equilibrium transformation temperature Ae3)+20 degree C.}.

The fifth aspect of the invention is the method for manufacturing hot-rolled sheet according to any one of the first to fourth aspects of the invention, wherein at least in the third rolling (40), a rolling lubricant is supplied between the rolled sheet and the rolls.

The sixth aspect of the invention is the method for manufacturing hot-rolled sheet according to the fifth aspect of the present invention, wherein Coulomb friction coefficient between the rolled sheet and the rolls of the third rolling (40), in which the rolling lubricant is supplied therebetween, is 0.25 or less.

The "Coulomb friction coefficient" under rolling is obtained by carrying out two-dimensional rolling analysis based on non-uniform rolling theory of OROWAN, and then by carrying out back-calculation using friction coefficient as a parameter such that a forward slip ratio and a rolling force agree with the actual measurement. While, the "forward slip ratio" can be obtained by marking the rolls in advance and thereafter measuring the distance between reprint of the mark on the steel sheet material.

The seventh aspect of the present invention solves the above problems by providing a hot-rolled sheet containing 0.04-0.20% C, 0.01-2.0% Si, 0.5-3.0% Mn by mass, and the reminder being Fe and inevitable impurities, a size D2 of ferrite grain at a quarter region of sheet thickness from the surfaces of the hot-rolled sheet being less than 2.0 μm, the relation among the size D2 of ferrite grain, a size D3 of ferrite grain at a central region of sheet thickness from the surfaces of the hot-rolled sheet, and a size D1 of ferrite grain at a position 50 μm in depth of sheet thickness from the surfaces of the hot-rolled sheet satisfying the expression: $(D3-D1)/D2 \leq 0.4$, and a grain size Dr in the rolling direction and a grain size Dt in the thickness direction of the ferrite grain at a position 50 μm in depth of sheet thickness from the surfaces of the hot-rolled sheet satisfying the expression (1).

$$|(Dr-Dt)/((Dr+Dt)/2)| \leq 0.25 \quad (1)$$

Here, each grain size represented by D1, D2, and D3 shows average grain size; the average grain size is a value obtained by line intercept method by ASTM. Moreover, grain sizes of D1, Dr, and Dt located 50 μm in depth of sheet thickness from the surfaces of the steel sheet have the following relation:

$$D1=(Dt+Dr)/2$$

Effects of the Invention

According to the present invention, ferrite grain size of carbon steel for general-purpose use can be extremely refined. As a result, the invention can enhance strength of the steel material without using any special (micro-alloying) elements; thereby the obtained product can be highly recycled and can reduce burden over the global environment.

In addition, since refinement of the ferrite grains and formation into a non-laminar equi-axed texture at the same time can be carried out, compared with a sheet having fine grain manufactured by a conventional method, the steel material obtained by the present invention shows higher formability in forming. Hence, the product by the method of the present invention can be used for various purposes.

Further, by rolling with lubrication in at least the step C, it becomes possible to manufacture a steel sheet which is capable of improving uniform formability, in forming, which is supposed to be disadvantageous by using a conventional sheet with fine grain.

Still further, by the conventional arts, load to the rolling mill for manufacturing sheets with ultrafine grain is high so that it is hard to introduce large-scale manufacturing facilities. According to the present invention, it is capable of significantly reducing the load to the rolling facilities; thereby introduction of a large-scale manufacturing facility becomes easier.

DESCRIPTION OF THE REFERENCE NUMERALS

Figure 1:
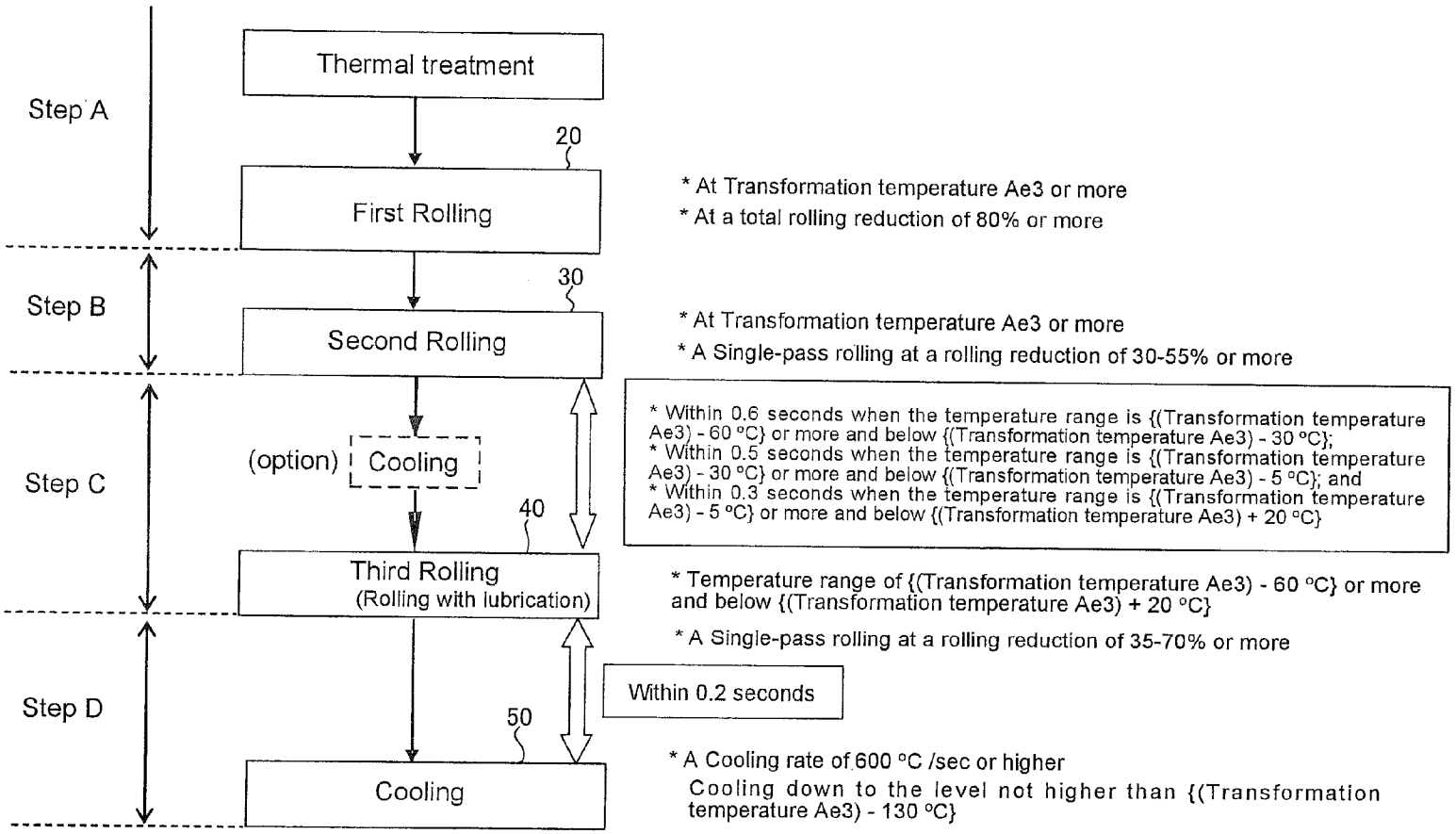
FIG. 1 is a flow chart illustrating the first mode of the manufacturing method of the present invention.

1 first stand (F1)
2 second stand (F2)
3 third stand (F3)
4 test piece
10 three-stand hot-rolling mill
11 reheating furnace
12 cooling equipment
13 interstand water-cooling header
14 lubrication header
20 first rolling
20' first rolling
30 second rolling
40 third rolling
50 cooling

BEST MODE FOR CARRYING OUT THE INVENTION

Such effects and advantages of the present inventions will be made apparent from the best mode for carrying out the invention, which will be described as follows.

First of all, a method for manufacturing a hot-rolled sheet of the present invention will be described as below.

FIG. 1 is a flow chart, having appropriate description, illustrating the manufacturing method S1 (hereinafter, referred to as "manufacturing method S1") of the hot-rolled sheet in relation to the first mode of the present invention. The manufacturing method S1 includes: a step A, a step B, a step C, and a step D, in the order mentioned. Each step will be described with reference to FIG. 1.

<Steel Sheet>

Before describing the manufacturing method S1, the steel sheet will be described. The components contained in the steel sheet may be the same as those contained in the conventional carbon steel. More particularly, the steel sheet contains: 0.04-0.20% C, 0.01-2.0% Si, 0.5-3.0% Mn by mass, and the reminder being Fe and inevitable impurities. Each component will be described in detail as follows.

Carbon (C): 0.04-0.20% by Mass

Carbon is an essential element to mainly secure strength of the steel; however, when large amount of carbon is contained, not only weldability in the steel material and formability at a time of press-forming are deteriorated, but also significant decline of ductility is caused. Therefore, the upper limit of the carbon content of the hot-rolled sheet having fine-grained ferrite of the invention is 0.20% by mass. On the other hand, as it becomes hard to gain grain refinement effect when carbon content is below 0.04% by mass, the lower limit of carbon content must be 0.04% by mass. Preferable carbon content is 0.07-0.16% by mass.

Silicon (Si): 0.01-2.0% by Mass

Silicon is an essential element for deoxidation during steel making and is an alloy element having effects to enhance formability of the steel sheet; however, when the content becomes over 2.0% by mass, ductility of the hot-rolled sheet having the fine-grain ferrite of the invention is deteriorated. Thus, the upper limit of silicon content must be 2.0% by mass. On the other hand, when silicon content is too small, deoxidation during steel making cannot be sufficiently carried out; thereby the lower limit of silicon content must be 0.01% by mass. Preferably silicon content is 0.01-1.5% by mass.

Manganese (Mn): 0.5-3.0% by Mass

Manganese is an inexpensive element and has an effect to enhance strength of the steel material. Manganese also inhibits brittleness at hot deformation temperature by behavior of sulfur and reduces the para-equilibrium transformation temperature Ae3. When manganese content is below 0.5% by mass, the effects cannot be sufficiently attained; thereby the lower limit of manganese content is 0.5% by mass. On the other hand, when manganese content is over 3.0% by mass, the effects are saturated, which rather deteriorates the formability of the hot-rolled sheet and damages the surface condition of the hot-rolled sheet; thereby it is not preferable. As a consequent, manganese content must be 3.0% by mass or less. Preferable manganese content is 0.5-2.0% by mass.

The steel sheet may be in a form of casted steel on their own; for the purpose of grain refinement of austenite and reducing inner defect caused by casting, the steel sheet is preferably treated by one or more hot-deformation to obtain austenite having grain size of 600 μm or less. More particularly, in the successive casting and hot-rolling process, the steel sheet may be in a condition where single pass or more rough-rolling has been completed. About the basic experiment in relation to the present invention, a material including ferrite texture having crystal grain size of about 30 μm was heated before the below-described A step at a predetermined temperature (for example, 1000-1200 degree C.) and kept the temperature for a predetermined time (for example, 1 to 2 hours) and the experiment was carried out on the presumption that austenite grain size was 30-600 μm.

Next, each step of the manufacturing method S1 will be described.

<Step A>

The step A is a step including a first rolling carried out at a total rolling reduction of 80% or more within the temperature range not lower than the para-equilibrium transformation temperature Ae3 where the texture becomes single phase of austenite. The first rolling is preferably multi-pass rolling; however it is not limited to. By the first rolling, it becomes possible to roll the post-heated material having austenite grain size of 30-600 μm into a rolled sheet whose austenite grain size is about 30 μm or less.

<Step B>

The step B is a step, following to the step A, includes a second rolling in which a single-pass rolling is carried out at a rolling reduction of 30-55% to the rolled sheet obtained from the step A within the temperature range not lower than the para-equilibrium transformation temperature Ae3. When the rolling reduction is lower than the above range, fine grain cannot be obtained. So far, the reason is not sure, but it is assumed that when rolling reduction is insufficient, strain accumulation by the rolling becomes insufficient. Moreover, when the rolling reduction becomes over the range, rolling load becomes excessive, which may causes problems of requirement of larger size facilities, excess of facility limit, and unsteadiness of rolling such as seizuring. The reason for setting the temperature range of the entry side temperature to not lower than the para-equilibrium transformation temperature Ae3 is because if the temperature before the second rolling is below the para-equilibrium transformation temperature Ae3, the time period when the rolled sheet is supercooled austenite becomes longer. This causes ferrite transformation of the rolled sheet by the beginning of the third rolling, and the final ferrite texture becomes a laminar having a lack of formability. Moreover, when the temperature before the second rolling is too high, recrystallization and recovery tend to occur and fine-grained ferrite becomes hard to be obtained; whereby it is preferable to set the temperature below {(the para-equilibrium transformation temperature Ae3)+30 degree C.}. The temperature before the second rolling can be adjusted by changing air cooling or waiting time. Alternatively, if it is necessary to significantly lower the temperature, water cooling may be carried out.

<Step C>

The step C is a step, following to the step B, including a third rolling in which a single-pass rolling is carried out at a rolling reduction of 35-70% to the rolled sheet obtained from the step B within a time period specified by the temperature range; it is described in detail as follows.

(Condition 1) When the temperature before the third rolling is {(the para-equilibrium transformation temperature Ae3)−60 degree C.} or more and below {(the para-equilibrium transformation temperature Ae3)−30 degree C.}, the third rolling as being a single-pass rolling at a rolling reduction of 35-70% is carried out within 0.6 seconds after the second rolling.

(Condition 2) When the temperature before the third rolling is {(the para-equilibrium transformation temperature Ae3)−30 degree C.} or more and below {(the para-equilibrium transformation temperature Ae3)−5 degree C.}, the third rolling as being a single-pass rolling at a rolling reduction of 35-70% is carried out within 0.5 seconds after the second rolling.

(Condition 3) When the temperature before the third rolling is {(the para-equilibrium transformation temperature Ae3)−5 degree C.} or more and below {(the para-equilibrium transformation temperature Ae3)+20 degree C.}, the third rolling as being a single-pass rolling at a rolling reduction of 35-70% is carried out within 0.3 seconds after the second rolling.

In order to enhance the strain accumulation effect, interval between the second rolling and the third rolling, i.e. interpass time, is preferably as short as possible; however, there are restrictions in shortening the interpass time by installation space of rolling stands and rolling speed. When the interpass time is the above upper value or more, the grain refinement effect is clearly decreased. The reason for this is presumed that the longer the interpass time between the second rolling in the step B and the third rolling in the step C is or the higher the temperature before the third rolling is, static recrystallization occurs; thereby strain accumulation becomes insufficient. By contrast, the fact, in which the lower the temperature before the third rolling is, the longer the time period between the second rolling and the third rolling may be, is presumed that lower temperature tends to inhibit recrystallization. When the temperature before the third rolling is set too low, ferrite transformation occurs before the third rolling so that the final ferrite texture tends to become a laminar texture. Thus, in the present invention, the temperature before the third rolling is set not less than {(the para-equilibrium transformation temperature Ae3)−60} degree C. It is thought that the lower limit temperature is correctly related to a time period required for cooling in the step C and the following step D. So as to effectively carry out "strain accumulation in the unrecrystallized region" which is assumed to be effective for the grain refinement, the step C must be carried out under any one of conditions 1, 2, and 3.

As a means to control the temperature before the third rolling of the step C to be {(the para-equilibrium transformation temperature Ae3)−60 degree C.} or more and below {(the para-equilibrium transformation temperature Ae3)+20 degree C.}, there may be predicting exothermic heat and temperature rising in the second rolling and adjusting the temperature before the second rolling such that the post-rolling temperature becomes within the above temperature range. In order to avoid transformation before rolling, the temperature before the second rolling is restricted to not lower than the para-equilibrium transformation temperature Ae3. On the other hand, as a means to inhibit temperature rising in the second rolling, there may be a method for increasing the amount of heat absorbed by roll by lowering the second rolling speed. However, in view of shortening the interpass time to the third rolling, there is a limit to reduce the rolling speed so that the temperature after rolling cannot be adjusted from time to time. Therefore, a means for cooling the steel sheet after the second rolling and before the third rolling is required. In view of enhancing flexibility of equipments' layout, use of fast cooling equipment, in which large amount of temperature drop can be obtained in short distance, is desirable; for instance, if temperature drop by 10 degree C. is required, so as to carry out cooling within the interpass time of 0.6 seconds at the longest, cooling speed of 17 degree C./sec or higher is required. From the viewpoint of minimizing interpass recrystallization and recovery as well as of enhancing strain accumulation effect, temperature adjustment by interpass cooling is preferably completed within a short period of time after the second rolling; the cooling is desirably completed just after the second rolling by using a cooling method having higher cooling speed.

When rolling reduction in the third rolling is below 35%, strain accumulation is insufficient; thereby effect for facilitating ferrite transformation in the following cooling step becomes insufficient. On the other hand, when rolling reduction of the third rolling is over 70%, recrystallization and transformation during forming occur and heat which is higher enough to affect the following cooling is generated by deformation; therefore refinement effect of the crystal grain is lost. Moreover, problems like excessive rolling load, necessity in introduction of large-scale manufacturing facilities, exceedance of equipment limit and unsteadiness of rolling are caused.

Further, in the third rolling, rolling may be carried out at a Coulomb friction coefficient of 0.25 or less while supplying rolling lubricant between the rolled sheet and the rolls. When the above first to third rollings are carried out without using rolling lubricant, particularly during a large reduction rolling, shear strain is generated in the surface of sheet. Due to the difference of amount of strain, difference of texture in the thickness direction is caused. In addition, particularly in the high-pressure high-speed rolling, heat generated by friction is high enough to affect the crystal grain refinement. By the temperature increase, ferrite grain refinement is sometimes disturbed.

By contrast, when rolling is carried out with lower friction coefficient by lubrication at least in the third rolling, amount of strain in the thickness direction is homogenized. Due to this, texture in the thickness direction becomes homogenized and heat generation by friction is reduced so that it is capable of controlling the excessive heat. Accordingly, it is advantageous for the grain refinement.

Further, as it is possible to reduce rolling load by rolling with lubrication, the upper limit of the rolling reduction restricted in view of equipment and heat generation can be raised. For example, when rolling reduction is 50%, if rolling with lubrication is carried out at a friction coefficient of $\mu=0.15$ to the rolling without lubrication at a friction coefficient of $\mu=0.4$, the rolling load can be reduced by 40% or more, temperature increase of the rolling sheet by friction can also be reduced by 50 degree C. or more. Therefore, temperature control at the entry side and exit side of the third rolling becomes easier; thus, it becomes possible to reduce the size and load of the cooling equipment. In order to sufficiently obtain the above effects, it is preferable to set the friction coefficient to 0.25 or less. Moreover, as the incidental effect, from the practical viewpoint like expansion in intended purpose use without revamping the current hot-rolling equipments, lubrication effect is remarkable.

Since ferrite texture of the final product is largely influenced by steel-sheet formation so that the steel must be lubricated in the third rolling; besides this, rolling with lubrication may be carried out in the first rolling and the second rolling. Further, when friction coefficient becomes below 0.1, ability of biting at the head portion of rolling sheet may be deteriorated during rolling; whereby friction coefficient is desirably 0.1 or more.

<Step D>

The step D is a step in which within 0.2 seconds after the step C, the rolled sheet is cooled at a cooling rate of 600 degree C./sec or higher to a temperature not higher than {(the para-equilibrium transformation temperature Ae3)−130 degree C.}. By the step D, a hot-rolled sheet containing fine-grained ferrite having an average grain size of 2.0 μm or less at a ratio of 50% or more can be obtained. When carrying out the cooling under the above-described condition, recrystallization and recovery of austenite are inhibited, then, ferrite transformation is facilitated. The cooling is preferably carried out down to a temperature within the range between {(the para-equilibrium transformation temperature Ae3)−200 degree C.} and {(the para-equilibrium transformation temperature Ae3)−130 degree C.}. In the above step D, the time period between the end of the third rolling in the step C and the beginning of the cooling is preferably within 0.1 seconds. Further, cooling speed is desirably set at 900 degree C./sec or higher. According to these conditions, it is possible to obtain a hot-rolled sheet containing fine-grained ferrite having an average grain size of 1.5 μm or less at a ratio of 50% or more.

By the manufacturing method S1 as above, ferrite grain size of the carbon steel for general purpose use can be significantly refined. More specifically, even by rolling without lubrication, it becomes possible to manufacture a hot-rolled sheet satisfying the conditions, in which the sheet does not contain a precipitation strengthening element, the grain size of the crystal is not excessively extended in the rolling direction, and the steel is transformed into ferrite crystal whose grain size is below 2 μm. By the method, it is capable of improving formability in forming. Then, by carrying out rolling with lubrication at least in the step C, a hot-rolled sheet having smaller difference of grain size in the thickness direction can be manufactured. As a consequence, it is possible to improve uniform formability in forming.

Figure 2:
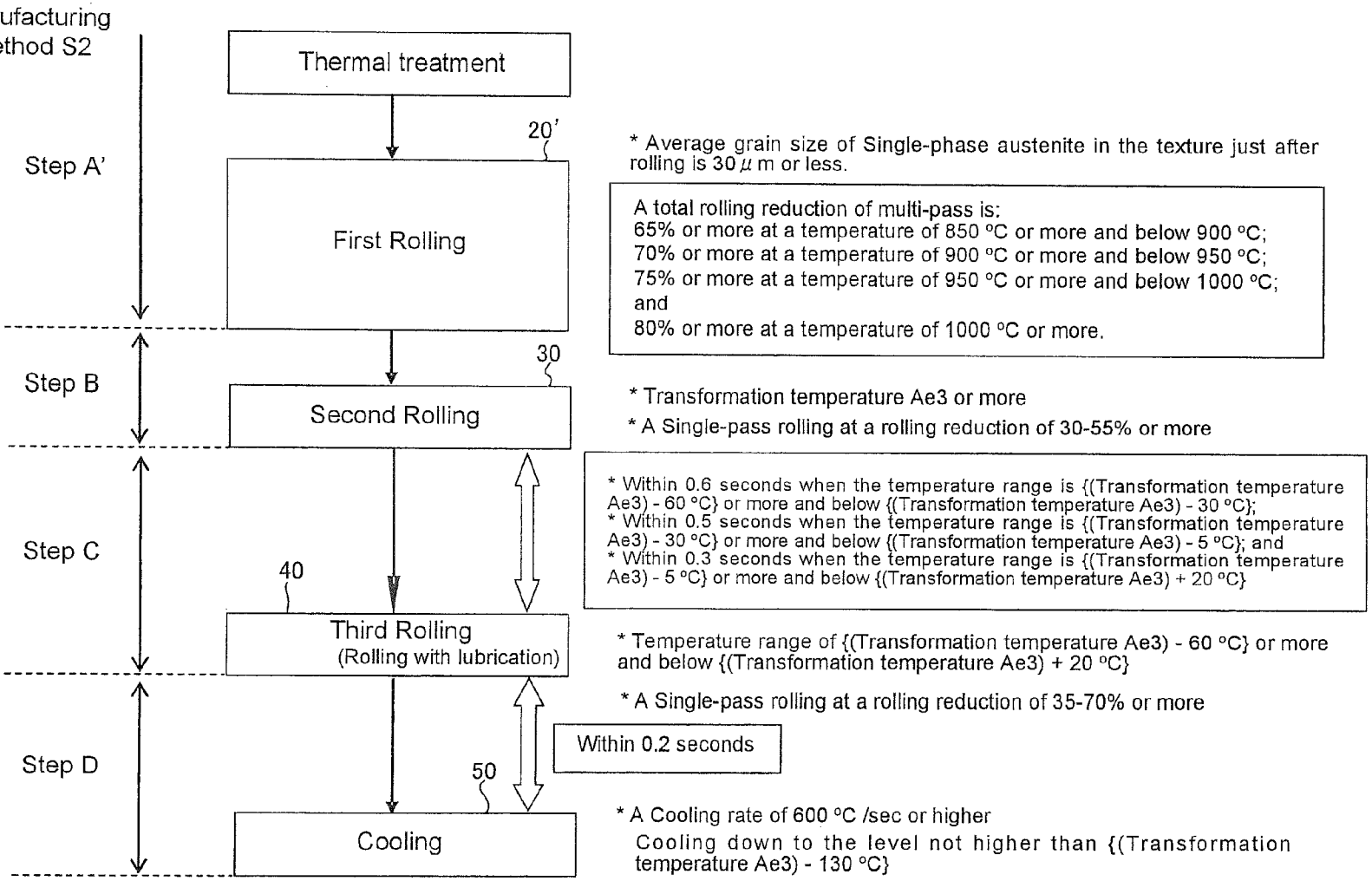
FIG. 2 is a flow chart illustrating the second mode of the manufacturing method of the invention.

FIG. 2 is a flow chart, having an appropriate description, illustrating the manufacturing method S2 (hereinafter, referred to as "manufacturing method S2") of the hot-rolled sheet in relation to the second mode of the present invention. The manufacturing method S2 includes: a step A', a step B, a step C, and a step D, in the order mentioned. Each step will be described with reference to FIG. 1. In other words, the manufacturing method S2 is the one in which the step A of the manufacturing method S1 is changed into the step A' so that the steps B, C, and D following the step A' are the same as those in the manufacturing method S1. Accordingly, here, the step A' is only described and description of rest of the steps are omitted.

The step A' is a step including a first rolling 20' in which a steel sheet is rolled such that the texture just after rolling is a single phase of austenite having a grain size of 30 μm or less. This is presumed that when the austenite grain size is smaller and the boundary area per unit volume is larger, strain is effectively accumulated in the post-process such as second rolling and the third rolling; moreover, nucleation site of transformation increases during the following ferrite transformation, which contributes to the refinement of the ferrite grain. In addition, if ferrite texture is mixed at the phase, it is extended by the rolling in the post-process and eventually remains in the finished sheet in a form of laminar deformed texture. Thus, in view of mechanical property of the steel sheet, it is not preferable.

In order to control the austenite grain size to 30 μm or less, in particular, successive multi-pass rolling is carried out: at a total rolling reduction of 65% or more when the entry side temperature is 850 degree C. or more and below 900 degree C.; at a total rolling reduction of 70% or more when the entry side temperature is 900 degree C. or more and below 950 degree C.; at a rolling reduction of 75% or more when the entry side temperature is 950 degree C. or more and below 1000 degree C.; and at a tolling reduction of 80% or more when the entry side temperature is 1000 degree C. or higher.

In the basic experiment related to the present invention, rolling was carried out through two to four passes, at a total rolling reduction of 60-80% and at a temperature before rolling of 830-1050 degree C. After rolling, the texture of the rolled material was frozen and the austenite grain size was measured. As a result, the inventors discovered the fact that if the rolling is carried out within the range of above temperature and total rolling reduction, average grain size of the austenite becomes 30 μm or less.

Conditions to make the average grain size of austenite 30 μm or less is not limited. However, if the rolling is carried out only by a single-pass rolling, single-pass extra-large reduction rolling method is required that raise the rolling load excessive; whereby it is not preferable. On the other hand, when the rolling reduction is specified when the pass number is increased too much, rolling reduction per single pass is reduced so that it becomes hard to obtain grain refinement effect by recrystallization of austenite grain; thereby it is not preferable. Thus, the rolling reduction per single pass is preferably 27% or more.

It should be noted that in the present invention, rolling can be carried out to a steel material before the first rolling, so rolling pass number from casted state to the finished product is not restricted. Moreover, the second rolling of the step B may be carried out within a short time after the above first rolling; by contrast, if the time period before the second rolling becomes longer, austenite grain grows, which is not preferable. In the basic experiment, in the case where the complete process was successively carried out, the second rolling was carried out within one to ten seconds after the last pass of the first rolling; within the above range, no significant difference of the finally-obtained ferrite texture can be seen.

By the manufacturing method S2 as described above, the same effect as that of the manufacturing method S1, i.e. significant ferrite grain refinement of the carbon steel for general purpose use, can be obtained. More precisely, even by rolling without lubrication, it becomes possible to manufacture a hot-rolled sheet satisfying the conditions, in which the sheet does not contain a precipitation strengthening element, the grain size of the crystal is not excessively extended in the rolling direction, and the steel is transformed into ferrite crystal whose grain size is below 2 μm. As a consequence, formability in forming can be improved. Then, by rolling with lubrication in at least the step C, it is also possible to manufacture a hot-rolled sheet having ferrite whose grain size difference in the thickness direction is smaller. Accordingly, the uniform formability in forming can be improved.

Manufacturing equipments used for the above manufacturing methods S1 and S2 preferably include a thermal treatment equipment, a tandem rolling equipment having two or more stands, and a cooling equipment disposed at the exit side of the rolling equipment. Each stands of the rolling equipment must attain a predetermined amount or more of rolling reduction. In addition, so as to set the interpass time between the second rolling and the third rolling to not longer than 0.6 seconds, a predetermined rolling speed is required and the neighboring rolling mills must be located within a predetermined distance. Moreover, the cooling equipment has to be disposed at the exit side of the tandem rolling equipment to immediately cool the rolled sheet after the third rolling. Further, when water cooling is carried out between the second rolling and the third rolling, the water cooling header must be disposed in a rolling mill housing or between the housings.

Next, the steel sheet of the present invention, which can be manufactured when rolling with lubrication is carried out in the manufacturing methods S1 and S2, is described. The hot-rolled sheet is as follows.

<Ferrite Phase>

The steel sheet of the invention contains ferrite phase as the main phase. So, a cross-sectional area of the ferrite phase to that of the steel sheet cut at a given section may be 50% or more; it is preferably 70% or more. Here, the term "main phase" means a phase which covers 50% or more to the entire area cut at any section of the steel sheet.

<Ferrite Grain Size>

The ferrite crystal of the steel sheet of the present invention has a predetermined distribution of grain size about the steel sheet in the thickness direction. The detail is as follows.

When the ferrite grain size at a position 50 μm in depth of sheet thickness from the surfaces of the steel sheet is named D1; the ferrite grain size at a quarter region of sheet thickness from the surfaces of the steel sheet is named D2; and the ferrite grain size at a central region of sheet thickness from the surfaces of the steel sheet is named D3, the above D1 to D3 satisfy the following expression (2).

$$(D3-D1)/D2 \leq 0.4 \quad (2)$$

D1, D2, and D3 as described herein represent the average grain size in the respective positions; the average grain size is obtained by using line intercept method by ASTM. By the expression (2), distribution ratio in the thickness direction can be quantitatively evaluated; so, if the D1 to D3 satisfy the expression (2), which means that a predetermined even grain-size distribution is obtained in the thickness direction of the steel sheet.

<Aspect Ratio of Ferrite Grain>

Further, in the ferrite grain at a position 50 μm in depth of sheet thickness from the surfaces of the steel sheet, when a grain size in the rolling direction is named Dr and a grain size in the thickness direction is named Dt, the steel sheet of the present invention satisfies the following expression (1).

$$|(Dr-Dt)/((Dr+Dt)/2)| \leq 10.25 \quad (1)$$

Dr and Dt as described herein can be obtained by separating the measurement in the rolling direction and the measurement in the thickness direction when microscopically-observing the ferrite texture at a section perpendicular to the width direction of the rolled material to calculate grain size by the line intercept method. By using the expression (1), it is capable of quantitatively evaluating the aspect ratio of the grains. If the obtained Dr and Dt satisfy the expression (1), which means that non-laminar texture is formed in the steel sheet.

According to the above steel sheet of the present invention, it becomes possible to improve formability and uniform formability in forming these of which have been thought to be disadvantageous for the conventional fine-grained ferrite. Moreover, since the sheet does not contain any precipitation strengthening element but is highly strengthened by grain refinement of steel sheet for general purpose use, the sheet exhibits excellent recycling rate of the products and contributes to reduce burden to the global environment.

EXAMPLES

Hereinafter, the present invention will be more specifically described by way of the following examples. However, the invention is not limited to the examples.

Example 1

In Example 1, in the case where lubrication was not given in the step C (friction coefficient: 0.4), rolling was carried out under various conditions. The conditions and the results will be described in detail as follows. Among the materials represented as steel types A to D respectively having components as shown in Table 1, A-type material was cut into pieces having a width of 100 mm and a length of 70-200 mm so as to use as test pieces. After keeping the test pieces in a reheating furnace at 1000 degree C. for one hour, hot-rolling and the following cooling was carried out. It should be noted that as shown in Table 1, the para-equilibrium transformation temperature Ae3 of the test piece made of A-type material was 830 degree C. The para-equilibrium transformation temperature Ae3 means a thermal equilibrium temperature where the steel initiates its ferrite transformation from a temperature of austenite region.

TABLE 1

| Type of Steel | Components of Test pieces (mass %) C | Si | Mn | P | S | Al | N | Para-equilibrium stransformation Temp. Ae3 |
|---|---|---|---|---|---|---|---|---|
| A | 0.15 | 0.01 | 0.74 | 0.02 | 0.002 | 0.02 | 0.002 | 830° C. |
| B | 0.10 | 0.23 | 0.80 | 0.03 | 0.005 | 0.04 | 0.004 | 800° C. |
| C | 0.20 | 0.01 | 0.97 | 0.03 | 0.004 | 0.03 | 0.003 | 770° C. |
| D | 0.15 | 0.01 | 1.52 | 0.03 | 0.003 | 0.03 | 0.003 | 750° C. |

Figure 3:
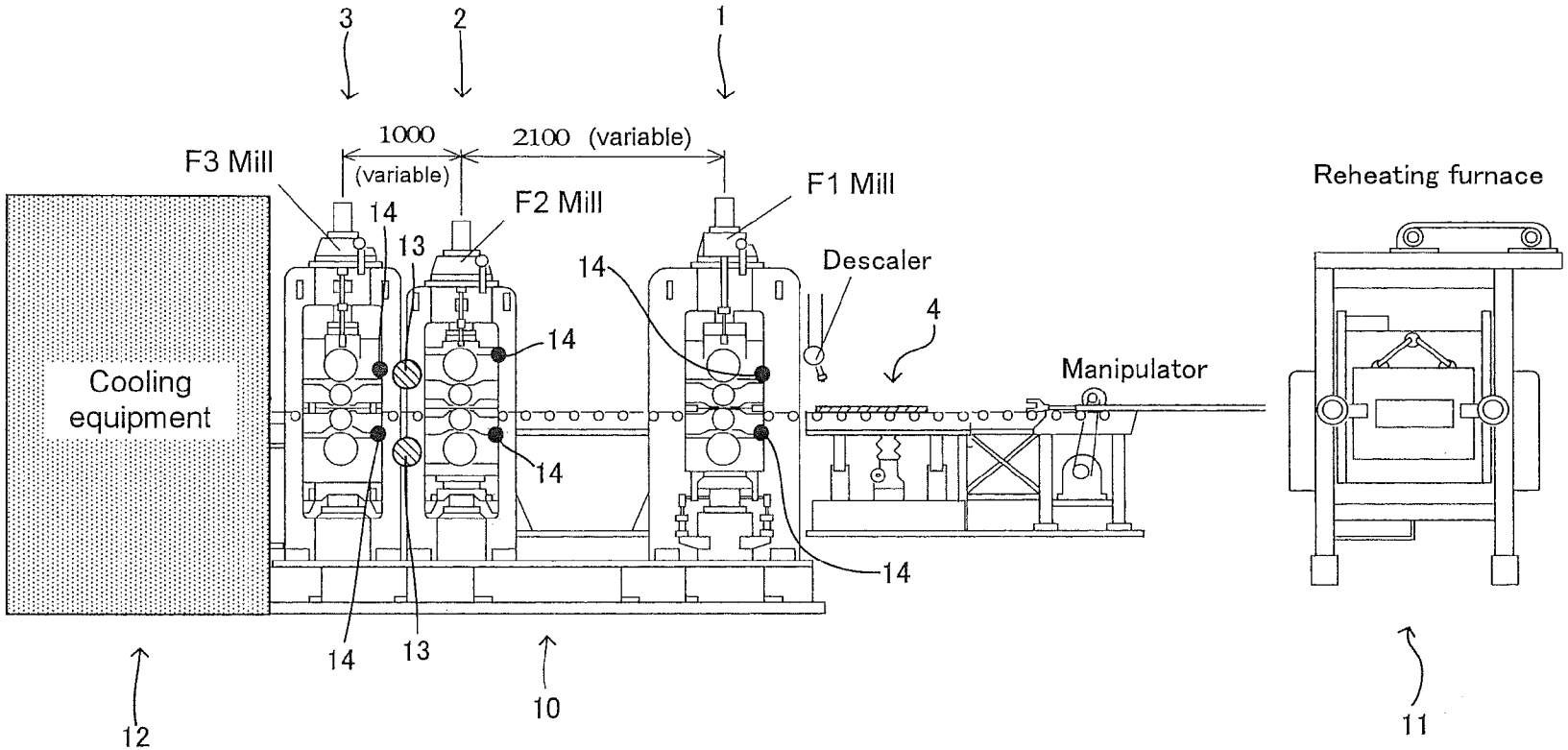
FIG. 3 is a view showing an example of rolling equipment.

The hot-rolling was carried out by producing and using a three-stand hot-rolling mill 10, as shown in FIG. 3, disposed to follow the reheating furnace 11. The distance between a first stand (F1) 1 and a second stand (F2) 2 was 2.1 m and the distance between the second stand (F2) 2 and a third stand (F3) 3 was 1.0 m, which made it possible to carry out rolling within the interpass time of 0.6 seconds. In addition, between the second stand (F2) 2 and the third stand (F3) 3, interstand water-cooling header 13 was provided. Rolling reduction of each rolling stand was set to 40% or more. The test piece 4 passed through the reheating furnace 11 and the following respective stands 1-3 was guided to a cooling equipment 12. Lubrication headers 14 were arranged at the entry side of each stand so that it was capable of injecting the lubricant towards work-rolls when lubrication was carried out. The specification of rolling mills and the rolling conditions are shown in Table 2.

TABLE 2

| Specification of Rolling mills/Rolling conditions | |
|---|---|
| Number of stands | 3 |
| Interstand distance | Between 1st-2nd stands: 2.1 m<br>Between 2nd-3rd stands: 1.0 m |
| Diameter of work-rolls | 200-220 mm |
| 1st Rolling | Pass number: 4-5<br>Interpass time: about 10 seconds |
| 2nd/3rd Rollings | Performed by 2nd and 3rd stands |

As shown in Table 2, test piece 4 was treated with 4 to 5 passes rolling by the first stand (F1) 1. After that, by the second stand (F2) 2 and the third stand (F3) 3, the second rolling and the third rolling were respectively carried out.

In Table 3, test conditions or the like of each step of the Examples are shown. The average γ (austenite) grain size as described in the table was obtained by preparing another test piece apart from the test piece provided to the following processes, conducting the first rolling under the same condition as above and being rapidly-cooled the test piece down to the room temperature, then measuring by observation of texture.

TABLE 3

| | | Step A | | | | Step B | | Step C | | |
|---|---|---|---|---|---|---|---|---|---|---|
| | | 1st Rolling | | | | 2nd Rolling | | | 3rd Rolling | |
| Test No. | Thickness of Test piece (mm) | Temp. before rolling (° C.) | TTL rolling reduction (%) | Number of Pass | Avg. γ grain size (μm) | Temp. before rolling (° C.) | Rolling reduction (%) | Cooling before 3rd rolling | Temp. before rolling (° C.) | Rolling reduction (%) |
| 1 | 35 | 950 | 80 | 3 | 25 | 830 | 45 | Included | 750 | 45 |
| 2 | 35 | 950 | 80 | 3 | 25 | 830 | 45 | Included | 770 | 45 |
| 3 | 35 | 950 | 80 | 3 | 25 | 830 | 45 | Included | 770 | 45 |
| 4 | 35 | 950 | 80 | 3 | 25 | 830 | 45 | Included | 800 | 45 |
| 5 | 35 | 950 | 80 | 3 | 25 | 830 | 45 | Included | 800 | 45 |
| 6 | 35 | 950 | 80 | 3 | 25 | 830 | 45 | Included | 820 | 45 |
| 7 | 35 | 950 | 80 | 3 | 25 | 830 | 45 | Included | 820 | 45 |
| 8 | 35 | 950 | 80 | 3 | 25 | 830 | 45 | None | 830 | 45 |
| 9 | 35 | 950 | 80 | 3 | 25 | 830 | 45 | None | 830 | 45 |
| 10 | 35 | 950 | 80 | 3 | 25 | 840 | 20 | Included | 770 | 45 |
| 11 | 35 | 950 | 80 | 3 | 25 | 780 | 45 | Included | 770 | 45 |
| 12 | 35 | 950 | 80 | 3 | 25 | 830 | 45 | Included | 770 | 45 |
| 13 | 35 | 950 | 80 | 3 | 25 | 830 | 45 | Included | 820 | 45 |
| 14 | 35 | 950 | 80 | 3 | 25 | 830 | 45 | Included | 810 | 30 |
| 15 | 35 | 950 | 80 | 3 | 25 | 830 | 45 | Included | 820 | 45 |
| 16 | 35 | 950 | 80 | 3 | 25 | 830 | 45 | Included | 820 | 45 |
| 17 | 35 | 875 | 60 | 2 | 35 | 830 | 45 | Included | 820 | 45 |
| 18 | 35 | 875 | 65 | 2 | 28 | 830 | 45 | Included | 820 | 45 |
| 19 | 35 | 925 | 68 | 3 | 35 | 830 | 45 | Included | 820 | 45 |
| 20 | 35 | 925 | 75 | 3 | 28 | 830 | 45 | Included | 820 | 45 |
| 21 | 35 | 975 | 74 | 3 | 33 | 830 | 45 | Included | 820 | 45 |
| 22 | 35 | 975 | 80 | 3 | 28 | 830 | 45 | Included | 820 | 45 |
| 23 | 35 | 950 | 73 | 4 | 35 | 830 | 45 | Included | 820 | 45 |
| 24 | 35 | 950 | 80 | 4 | 30 | 830 | 45 | Included | 820 | 45 |
| 25 | 35 | 950 | 80 | 4 | 30 | 830 | 45 | Included | 790 | 50 |

TABLE 3-continued

| | Step C | | | | | | | | |
|---|---|---|---|---|---|---|---|---|---|
| | 3rd Rolling | | | Step D | | | | | |
| Test No. | Interpass time before rolling (sec) | Friction coefficient | Temp. after rolling (° C.) | Time between rolling-cooling (sec) | Cooling rate (° C./sec) | Cooling-stop Temp. (° C.) | Avg. grain size (μm) | Features of Texture | Notes |
| 1 | 0.7 | 0.4 | 760 | 0.2 | 600 | 650 | 1.6 | Laminar | Comparative example |
| 2 | 0.6 | 0.4 | 785 | 0.2 | 600 | 650 | 1.6 | Equiaxed | Example |
| 3 | 0.8 | 0.4 | 770 | 0.2 | 600 | 650 | 2.1 | Equiaxed | Comparative example |
| 4 | 0.5 | 0.4 | 815 | 0.2 | 600 | 650 | 1.8 | Equiaxed | Example |
| 5 | 0.7 | 0.4 | 800 | 0.2 | 600 | 650 | 2.2 | Equiaxed | Comparative example |
| 6 | 0.4 | 0.4 | 845 | 0.2 | 600 | 650 | 1.9 | Equiaxed | Example |
| 7 | 0.6 | 0.4 | 835 | 0.2 | 600 | 650 | 2.4 | Equiaxed | Comparative example |
| 8 | 0.3 | 0.4 | 855 | 0.2 | 600 | 650 | 1.9 | Equiaxed | Example |
| 9 | 0.6 | 0.4 | 845 | 0.2 | 600 | 650 | 2.5 | Equiaxed | Comparative example |
| 10 | 0.6 | 0.4 | 785 | 0.2 | 600 | 650 | 2.3 | Equiaxed | Comparative example |
| 11 | 0.3 | 0.4 | 800 | 0.2 | 600 | 650 | 1.6 | Laminar | Comparative example |
| 12 | 0.6 | 0.4 | 785 | 0.5 | 100 | 650 | 4.5 | Equiaxed | Comparative example |
| 13 | 0.6 | 0.4 | 835 | 0.5 | 100 | 650 | 5.1 | Equiaxed | Comparative example |
| 14 | 0.3 | 0.4 | 810 | 0.2 | 600 | 650 | 2.5 | Equiaxed | Comparative example |
| 15 | 0.3 | 0.4 | 840 | 0.2 | 250 | 650 | 2.6 | Equiaxed | Comparative example |
| 16 | 0.3 | 0.4 | 840 | 0.2 | 600 | 710 | 3.5 | Equiaxed | Comparative example |
| 17 | 0.4 | 0.4 | 845 | 0.2 | 600 | 650 | 2.3 | Equiaxed | Comparative example |
| 18 | 0.4 | 0.4 | 845 | 0.2 | 600 | 650 | 1.9 | Equiaxed | Reference example |
| 19 | 0.4 | 0.4 | 845 | 0.2 | 600 | 650 | 2.3 | Equiaxed | Comparative example |
| 20 | 0.4 | 0.4 | 845 | 0.2 | 600 | 650 | 1.9 | Equiaxed | Reference example |
| 21 | 0.4 | 0.4 | 845 | 0.2 | 600 | 650 | 2.3 | Equiaxed | Comparative example |
| 22 | 0.4 | 0.4 | 845 | 0.2 | 600 | 650 | 1.9 | Equiaxed | Example |
| 23 | 0.4 | 0.4 | 845 | 0.2 | 600 | 650 | 2.3 | Equiaxed | Comparative example |
| 24 | 0.4 | 0.4 | 845 | 0.2 | 600 | 650 | 1.9 | Equiaxed | Example |
| 25 | 0.2 | 0.4 | 820 | 0.1 | 1500 | 630 | 1.2 | Equiaxed | Example |

Table 3, at the same time, shows average grain size after rolling. The average grain size was obtained by line intercept method by ASTM. Each test will be studied with reference to Table 3. As above, the para-equilibrium transformation temperature Ae3 of the A-type steel material which is provided in the Example 1 is 830 degree C.:

(The para-equilibrium transformation temperature *Ae*)−60 degree C.=770 degree C.;

(The para-equilibrium transformation temperature *Ae*)−30 degree C.=800 degree C.;

(The para-equilibrium transformation temperature *Ae*)−5 degree C.=825 degree C.; and (The para-equilibrium transformation temperature *Ae*)+20 degree C.=850 degree C.

In Test No. 1, temperature before rolling in the step C was 750 degree C., which did not satisfy the requirement to be 770 degree C. or higher; therefore, the texture became laminar. This is assumed that amount of supercooling not higher than the para-equilibrium transformation temperature Ae had been excessively large thereby ferrite transformation had already occurred before the third rolling.

Test No. 2 satisfied the manufacturing method of the present invention so that refined grains having a size of 1.6 μm was obtained.

In Test No. 3, although the entry side temperature before the third rolling in the step C was required to be 770 degree C. and the interpass time before rolling was required to be within 0.6 seconds, it was 0.8 seconds. Thus, grain size was enlarged. This is because the strain accumulation was insufficient due to the cause of static recrystallization.

Test No. 4 satisfied the manufacturing method of the present invention so that refined grains having a size of 1.8 μm was obtained.

In Test No. 5, although the entry side temperature before the third rolling in the step C was required to be 800 degree C. and the interpass time before rolling was required to be within 0.5 seconds, it was 0.7 seconds. Thus, grain size was enlarged. This is because the strain accumulation was insufficient due to the cause of static recrystallization.

Test No. 6 satisfied the manufacturing method of the present invention so that refined grains having a size of 1.9 μm was obtained.

Test No. 7 was the same as Test No. 5.

Test No. 8 satisfied the manufacturing method of the present invention so that refined grains having a size of 1.9 μm was obtained.

In Test No. 9, although the entry side temperature before the third rolling in the step C was required to be 830 degree C. and the interpass time before rolling was required to be within 0.3 seconds, it was 0.6 seconds. Thus, grain size was enlarged. This is because the strain accumulation was insufficient due to the cause of static recrystallization.

In Test No. 10, rolling reduction of the second rolling in the step B was 20%, which did not satisfy the requirement within the range of 30-55% of the present invention. This is assumed to be caused by insufficient strain accumulation and heightening the density of dislocation. Hence, the grain was not refined.

In Test No. 11, a laminar texture was obtained. This is because temperature before the second rolling in the step B was 780 degree C. which was lower than the para-equilibrium transformation temperature Ae3 so that ferrite transformation had occurred before the third rolling.

In Test Nos. 12 and 13, time period between rolling-cooling in the step D was 0.5 seconds, which was longer than that of the present invention, cooling rate was also slow. Due to this, grain refinement was not carried out.

In Test No. 14, rolling reduction of the second rolling in the step C was 30%, which did not satisfy the requirement within the range of 35-60% of the present invention. This is assumed to be caused by insufficient strain accumulation and heightening the density of dislocation. Hence, the grain was not refined.

In Test No. 15, since the cooling rate in the step D was 250 degree C./sec, which was insufficient. This is assumed that inhibition of recrystallization and recovery were insufficient whereby ferrite transformation was not appropriately facilitated.

In Test No. 16, terminated temperature of cooling in the step D was 710 degree C., which was not the temperature of "(the para-equilibrium transformation temperature Ae3)−130 degree C." or less, in other words, which was not 700 degree C. or less. Due to this, acceleration of ferrite transformation by cooling was not sufficient and grain growth after ferrite transformation was significant.

Test No. 17 did not satisfy the requirement of the present invention because a total rolling reduction in the first rolling was below 80% and austenite grain size after first rolling was 30 μm or more. Therefore, it is assumed that strain accumulation in the second and third rollings was insufficient; thereby nucleation site of ferrite transformation became insufficient.

Test No. 18, although a total rolling reduction is lower than 80%, it not only satisfied an austenite grain size after the first rolling of 30 μm or less but also satisfied the requirement of the present invention in relation to other steps; thereby fine grains were obtained.

Test No. 19 was the same as Test No. 17.

Test No. 20 was the same as Test No. 18.

Test No. 21 was the same as Test No. 17.

Test No. 22 not only satisfied a total rolling reduction being 80% but also satisfied the requirement of the present invention in relation to other steps; thereby a steel sheet having fine grains was obtained.

Test No. 23 was the same as Test No. 17.

Test Nos. 24 and 25 were the same as Test No. 22.

As above, by satisfying requirement in each step of the present invention, it was capable of obtaining a steel sheet having fine grains whose size was below 2.0 μm by rolling without lubrication.

Example 2

In Example 2, tests were carried out in a case where a friction coefficient was set to 0.25 or less by supplying lubricant in the step C. Rolling equipments were the same as those of Example 1. Each material represented as steel types A to D respectively prepared to have components as shown in Table 1 was cut into pieces having a width of 100 mm and a length of 70-200 mm to produce test pieces. After keeping the test pieces in a reheating furnace at 1000 degree C. for one hour, hot-rolling and the following cooling were carried out. It should be noted that as described in Table 1, the para-equilibrium transformation temperatures Ae3 of the test pieces of types-A, B, C, D were respectively 830 degree C., 800 degree C., 770 degree C., and 750 degree C. In Table 4, test conditions or the like of each step of Example 2 are shown. The average γ (austenite) grain size as described in the table was obtained by preparing another test piece apart from the test piece provided to the following processes, conducting the first rolling under the same condition as above and being rapidly-cooled the test piece down to the room temperature, then measuring by observation of texture.

TABLE 4

| | | | Step A | | | | Step B | | Step C | |
|---|---|---|---|---|---|---|---|---|---|---|
| | | | 1st Rolling | | | | 2nd Rolling | | | 3rd Rolling |
| Test No. | Thickness of Test piece (mm) | Type of Steel | Temp. before rolling (° C.) | TTL rolling reduction (%) | Number of Pass | Avg.γ grain size (μm) | Temp. before rolling (° C.) | Rolling reduction (%) | Cooling before 3rd rolling | Temp. before rolling (° C.) |
| 1 | 35 | A | 950 | 80 | 4 | 25 | 830 | 45 | Included | 750 |
| 11 | 35 | A | 950 | 80 | 4 | 25 | 780 | 45 | Included | 770 |
| 25 | 35 | A | 950 | 80 | 4 | 30 | 830 | 45 | Included | 790 |
| 26 | 35 | A | 950 | 80 | 4 | 30 | 830 | 45 | Included | 790 |
| 27 | 35 | A | 950 | 80 | 4 | 30 | 830 | 45 | Included | 790 |
| 28 | 35 | A | 950 | 80 | 4 | 30 | 830 | 45 | Included | 790 |
| 29 | 35 | A | 950 | 80 | 4 | 30 | 830 | 45 | Included | 790 |
| 30 | 35 | A | 950 | 80 | 3 | 25 | 830 | 45 | Included | 770 |
| 31 | 35 | A | 950 | 80 | 3 | 25 | 830 | 45 | Included | 770 |
| 32 | 35 | A | 950 | 80 | 3 | 25 | 830 | 45 | Included | 800 |
| 33 | 35 | A | 950 | 80 | 3 | 25 | 830 | 45 | Included | 800 |
| 34 | 35 | A | 950 | 80 | 3 | 25 | 830 | 45 | Included | 820 |
| 35 | 35 | A | 950 | 80 | 3 | 25 | 830 | 45 | Included | 820 |
| 36 | 35 | A | 950 | 80 | 3 | 25 | 830 | 45 | None | 830 |
| 37 | 35 | A | 950 | 80 | 3 | 25 | 830 | 45 | None | 830 |
| 38 | 35 | A | 950 | 80 | 3 | 25 | 840 | 20 | Included | 770 |
| 39 | 35 | A | 950 | 80 | 3 | 25 | 830 | 45 | Included | 770 |
| 40 | 35 | A | 950 | 80 | 3 | 25 | 830 | 45 | Included | 820 |
| 41 | 35 | A | 950 | 80 | 3 | 25 | 830 | 45 | Included | 810 |
| 42 | 35 | A | 950 | 80 | 3 | 25 | 830 | 45 | Included | 820 |
| 43 | 35 | A | 950 | 80 | 3 | 25 | 830 | 45 | Included | 820 |
| 44 | 35 | A | 875 | 60 | 2 | 35 | 830 | 45 | Included | 820 |
| 45 | 35 | A | 875 | 65 | 2 | 28 | 830 | 45 | Included | 820 |
| 46 | 35 | A | 925 | 68 | 3 | 35 | 830 | 45 | Included | 820 |
| 47 | 35 | A | 925 | 75 | 3 | 28 | 830 | 45 | Included | 820 |
| 48 | 35 | A | 975 | 74 | 3 | 33 | 830 | 45 | Included | 820 |

TABLE 4-continued

| | | | | | | | | | | |
|---|---|---|---|---|---|---|---|---|---|---|
| 49 | 35 | A | 975 | 80 | 3 | 28 | 830 | 45 | Included | 820 |
| 50 | 35 | A | 950 | 73 | 4 | 35 | 830 | 45 | Included | 820 |
| 51 | 35 | A | 950 | 80 | 4 | 30 | 830 | 45 | Included | 820 |
| 52 | 35 | B | 950 | 80 | 4 | 30 | 810 | 45 | Included | 790 |
| 53 | 35 | C | 950 | 80 | 4 | 30 | 780 | 45 | Included | 760 |
| 54 | 35 | D | 950 | 80 | 4 | 30 | 750 | 45 | Included | 740 |

| | Step C | | | | | | | |
|---|---|---|---|---|---|---|---|---|
| | 3rd Rolling | | | | Step D | | | |
| Test No. | Rolling reduction (%) | Interpass time before rolling (sec) | Friction coefficient | Temp. after rolling (° C.) | Time between rolling-cooling (sec) | Cooling rate (° C./sec) | Cooling-stop Temp. (° C.) | Notes |
| 1 | 45 | 0.7 | 0.4 | 760 | 0.2 | 600 | 650 | |
| 11 | 45 | 0.3 | 0.4 | 800 | 0.2 | 600 | 650 | |
| 25 | 50 | 0.2 | 0.4 | 820 | 0.1 | 1500 | 630 | |
| 26 | 50 | 0.2 | 0.3 | 815 | 0.1 | 1500 | 630 | |
| 27 | 50 | 0.2 | 0.25 | 810 | 0.1 | 1500 | 630 | Mfg. method S1, S2 + lub. |
| 28 | 50 | 0.2 | 0.2 | 805 | 0.1 | 1500 | 630 | Mfg. method S1, S2 + lub. |
| 29 | 50 | 0.2 | 0.15 | 800 | 0.1 | 1500 | 630 | Mfg. method S1, S2 + lub. |
| 30 | 50 | 0.6 | 0.15 | 770 | 0.2 | 600 | 650 | Mfg. method S1, S2 + lub. |
| 31 | 50 | 0.8 | 0.15 | 755 | 0.2 | 600 | 650 | |
| 32 | 50 | 0.5 | 0.15 | 800 | 0.2 | 600 | 650 | Mfg. method S1, S2 + lub. |
| 33 | 50 | 0.7 | 0.15 | 785 | 0.2 | 600 | 650 | |
| 34 | 50 | 0.4 | 0.15 | 830 | 0.2 | 600 | 650 | Mfg. method S1, S2 + lub. |
| 35 | 50 | 0.6 | 0.15 | 820 | 0.2 | 600 | 650 | |
| 36 | 50 | 0.3 | 0.15 | 840 | 0.2 | 600 | 650 | Mfg. method S1, S2 + lub. |
| 37 | 50 | 0.6 | 0.15 | 830 | 0.2 | 600 | 650 | |
| 38 | 50 | 0.6 | 0.15 | 770 | 0.2 | 600 | 650 | |
| 39 | 50 | 0.6 | 0.15 | 770 | 0.5 | 100 | 650 | |
| 40 | 50 | 0.6 | 0.15 | 820 | 0.5 | 100 | 650 | |
| 41 | 30 | 0.3 | 0.15 | 795 | 0.2 | 600 | 650 | |
| 42 | 50 | 0.3 | 0.15 | 825 | 0.2 | 250 | 650 | |
| 43 | 50 | 0.3 | 0.15 | 825 | 0.2 | 600 | 710 | |
| 44 | 50 | 0.4 | 0.15 | 830 | 0.2 | 600 | 650 | |
| 45 | 50 | 0.4 | 0.15 | 830 | 0.2 | 600 | 650 | Mfg. method S2 + lub. |
| 46 | 50 | 0.4 | 0.15 | 830 | 0.2 | 600 | 650 | |
| 47 | 50 | 0.4 | 0.15 | 830 | 0.2 | 600 | 650 | Mfg. method S2 + lub. |
| 48 | 50 | 0.4 | 0.15 | 830 | 0.2 | 600 | 650 | |
| 49 | 50 | 0.4 | 0.15 | 830 | 0.2 | 600 | 650 | Mfg. method S1, S2 + lub. |
| 50 | 50 | 0.4 | 0.15 | 830 | 0.2 | 600 | 650 | |
| 51 | 50 | 0.4 | 0.15 | 830 | 0.2 | 600 | 650 | Mfg. method S1, S2 + lub. |
| 52 | 50 | 0.2 | 0.15 | 800 | 0.1 | 1500 | 600 | Mfg. method S1, S2 + lub. |
| 53 | 50 | 0.2 | 0.15 | 770 | 0.1 | 1500 | 640 | Mfg. method S1, S2 + lub. |
| 54 | 50 | 0.2 | 0.15 | 760 | 0.1 | 1500 | 630 | Mfg. method S1, S2 + lub. |

In Table 4, together with Test Nos. 1, 11, and 25 shown in Example 1, manufacturing conditions in relation to other Test Nos. 26-54 are shown. Among the tests shown in Table 4, the test as identified by the term "manufacturing method S1" described in the Notes is the one producing a steel sheet by a manufacturing method having rolling with lubrication at a Coulomb friction coefficient of 0.25 or less in the step C as described in the above manufacturing method S1. In the same manner, the test as identified by the term "manufacturing method S2" described in the Notes is the one producing a steel sheet by a manufacturing method having rolling with lubrication at a Coulomb friction coefficient of 0.25 or less in the step C as described in the above manufacturing method S2. Further, to the test which can be carried out by either one of the manufacturing method, "manufacturing method S1, S2" is labeled. Manufacturing method whose column of "Notes" is blank is the one that does satisfy neither of manufacturing methods.

TABLE 5

| | | | Size D1 of grain at 50 μm in depth from Surface layer | | | Size D2 of | Size D3 of |
|---|---|---|---|---|---|---|---|
| Test No. | Steel type | Avg. grain size (μm) | Rolling direction Dr (μm) | Sheet thickness direction Dt (μm) | Avg. grain size D1 (μm) | grain ¼ in depth of sheet thickness (μm) | grain ½ in depth of sheet thickness (μm) |
| 1 | A | 1.62 | 1.50 | 1.00 | 1.25 | 1.60 | 2.00 |
| 11 | A | 1.62 | 1.80 | 0.90 | 1.35 | 1.70 | 1.80 |
| 25 | A | 1.17 | 0.95 | 0.85 | 0.90 | 1.08 | 1.54 |
| 26 | A | 1.17 | 0.95 | 0.85 | 0.90 | 1.10 | 1.50 |
| 27 | A | 1.19 | 1.03 | 0.90 | 0.97 | 1.14 | 1.45 |
| 28 | A | 1.20 | 1.05 | 0.92 | 0.99 | 1.17 | 1.43 |

TABLE 5-continued

| | | | | | | | |
|---|---|---|---|---|---|---|---|
| 29 | A | 1.21 | 1.10 | 0.94 | 1.02 | 1.20 | 1.40 |
| 30 | A | 1.58 | 1.40 | 1.30 | 1.35 | 1.60 | 1.80 |
| 31 | A | 2.10 | 1.90 | 1.70 | 1.80 | 2.10 | 2.40 |
| 32 | A | 1.82 | 1.70 | 1.60 | 1.65 | 1.80 | 2.00 |
| 33 | A | 2.17 | 1.80 | 1.80 | 1.80 | 2.20 | 2.50 |
| 34 | A | 1.87 | 1.60 | 1.60 | 1.60 | 1.90 | 2.10 |
| 35 | A | 2.30 | 1.80 | 1.80 | 1.80 | 2.40 | 2.70 |
| 36 | A | 1.90 | 1.60 | 1.60 | 1.60 | 1.90 | 2.20 |
| 37 | A | 2.50 | 2.00 | 2.00 | 2.00 | 2.50 | 3.00 |
| 38 | A | 2.30 | 2.00 | 1.80 | 1.90 | 2.30 | 2.70 |
| 39 | A | 4.38 | 3.80 | 3.50 | 3.65 | 4.50 | 5.00 |
| 40 | A | 5.20 | 4.50 | 4.50 | 4.50 | 5.10 | 6.00 |
| 41 | A | 2.50 | 2.00 | 2.00 | 2.00 | 2.50 | 3.00 |
| 42 | A | 2.63 | 2.10 | 2.10 | 2.10 | 2.60 | 3.20 |
| 43 | A | 3.60 | 2.80 | 2.80 | 2.80 | 3.50 | 4.50 |
| 44 | A | 2.30 | 1.80 | 1.80 | 1.80 | 2.30 | 2.80 |
| 45 | A | 1.90 | 1.60 | 1.60 | 1.60 | 1.90 | 2.20 |
| 46 | A | 2.33 | 2.00 | 2.00 | 2.00 | 2.30 | 2.70 |
| 47 | A | 1.90 | 1.60 | 1.60 | 1.60 | 1.90 | 2.20 |
| 48 | A | 2.30 | 2.00 | 2.00 | 2.00 | 2.30 | 2.60 |
| 49 | A | 1.87 | 1.60 | 1.60 | 1.60 | 1.90 | 2.10 |
| 50 | A | 2.33 | 2.00 | 2.00 | 2.00 | 2.30 | 2.70 |
| 51 | A | 1.90 | 1.60 | 1.60 | 1.60 | 1.90 | 2.20 |
| 52 | B | 1.43 | 1.30 | 1.15 | 1.23 | 1.44 | 1.62 |
| 53 | C | 1.18 | 1.15 | 0.97 | 1.06 | 1.05 | 1.42 |
| 54 | D | 1.13 | 1.02 | 0.92 | 0.97 | 1.08 | 1.35 |

| | | | Mechanical prolerty | | |
|---|---|---|---|---|---|
| Test No. | Distribution ratio of grain-size (D3 − D1)/D2 | Ratio of grain-shape (Dr − Dt)/D1 | Tensile strength (MPa) | Elongation (%) | Notes |
| 1 | 0.47 | 0.40 | 600 | 8 | |
| 11 | 0.26 | 0.67 | 590 | 5 | |
| 25 | 0.52 | 0.11 | 670 | 14 | |
| 26 | 0.50 | 0.11 | 665 | 15 | |
| 27 | 0.40 | 0.13 | 650 | 17 | Mfg. method S1, S2 + lub. |
| 28 | 0.37 | 0.13 | 645 | 19 | Mfg. method S1, S2 + lub. |
| 29 | 0.31 | 0.16 | 640 | 20 | Mfg. method S1, S2 + lub. |
| 30 | 0.28 | 0.07 | — | — | Mfg. method S1, S2 + lub. |
| 31 | 0.29 | 0.11 | — | — | |
| 32 | 0.19 | 0.06 | — | — | Mfg. method S1, S2 + lub. |
| 33 | 0.32 | 0.00 | — | — | |
| 34 | 0.26 | 0.00 | — | — | Mfg. method S1, S2 + lub. |
| 35 | 0.38 | 0.00 | — | — | |
| 36 | 0.32 | 0.00 | — | — | Mfg. method S1, S2 + lub. |
| 37 | 0.40 | 0.00 | — | — | |
| 38 | 0.35 | 0.11 | — | — | |
| 39 | 0.30 | 0.08 | — | — | |
| 40 | 0.29 | 0.00 | — | — | |
| 41 | 0.40 | 0.00 | — | — | |
| 42 | 0.42 | 0.00 | — | — | |
| 43 | 0.49 | 0.00 | — | — | |
| 44 | 0.43 | 0.00 | — | — | |
| 45 | 0.32 | 0.00 | — | — | Mfg. method S2 + lub. |
| 46 | 0.30 | 0.00 | — | — | |
| 47 | 0.32 | 0.00 | — | — | Mfg. method S2 + lub. |
| 48 | 0.26 | 0.00 | — | — | |
| 49 | 0.26 | 0.00 | — | — | Mfg. method S1, S2 + lub. |
| 50 | 0.30 | 0.00 | — | — | |
| 51 | 0.32 | 0.00 | — | — | Mfg. method S1, S2 + lub. |
| 52 | 0.27 | 0.12 | 620 | 21 | Mfg. method S1, S2 + lub. |
| 53 | 0.34 | 0.17 | 680 | 13 | Mfg. method S1, S2 + lub. |
| 54 | 0.35 | 0.10 | 695 | 17 | Mfg. method S1, S2 + lub. |

Together with grain size: D1, D2, D3, Dr, and Dt, Table 5 shows distribution ratio of grain size and grain shape ratio at the above-described respective position. In addition, mechanical property of the steel sheet is shown. As understood from Table 5, a steel sheet produced by the manufacturing methods S1 or S2, in which appropriate rolling with lubrication was conducted in the step C, exhibits excellent uniformity of distribution of grain size in the thickness direction and shows smaller aspect ratio of the grain shape. As it were, it became a sheet having a non-laminar texture. According to these methods, it is possible to obtain a hot-rolled sheet which exhibits favorable elongation and excellent formability. With respect to the mechanical property, actual measurement was carried out only about examples of Test Nos. 1, 11, 25-29, and 52-54. Test Nos. 1, 11, and 25-29 are the examples using steel type-A; among them, the steel sheets produced by the manufacturing method S1 or S2 show higher elongation. On the other hand, about Test Nos. 52-54, although direct comparison with the above Test Nos. cannot be carried out due to the different contents, it is possible to gain the high performance considered from the texture. As for Test No. 53, elongation value is smaller compared with others; this is attributed to contain a large quantity of carbon (C) in the steel type-C. Accordingly, mechanical property considered from the texture can be seen remarkably.

As seen above, by conducting rolling with lubrication in at least the step C, particularly at a friction coefficient of 0.25 or less, it becomes possible to obtain a steel sheet whose distribution of grain size and grain shape becomes favorable and which is advantageous in formability.

Figure 4:
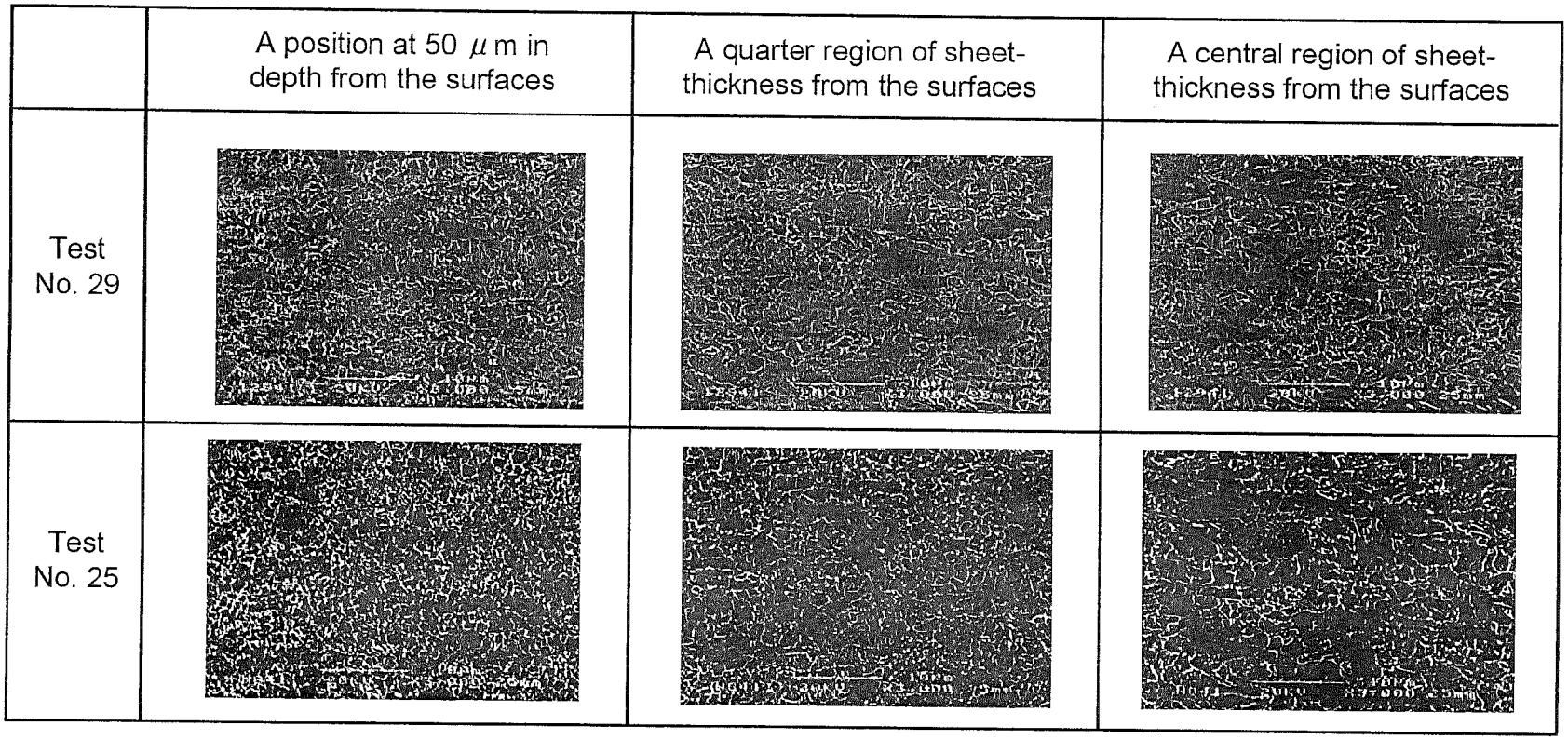
FIG. 4 is a magnified view of texture as a result of a part of steel sheets of the examples.

FIG. 4 shows magnified views of steel sheet texture as a result of test with and without lubrication. The test with lubrication is Test No. 29; while, the test without lubrication is Test No. 25. According to these views, it can also be understood that a steel sheet having a non-laminar texture can be obtained by use of the manufacturing method S1 or S2.

The above has described the present invention associated with the most practical and preferred embodiments thereof. However, the invention is not limited to the embodiments disclosed in the specification. Thus, the invention can be appropriately varied as long as the variation is not contrary to the subject substance and conception of the invention which can be read out from the claims and the whole contents of the specification. It should be understood that a method for manufacturing hot-rolled sheet having fine-grained ferrite and the hot-rolled sheet produced by the method with such an alternation are included in the technical scope of the invention.

The invention claimed is:

1. A hot-rolled sheet containing 0.04-0.20% C, 0.01-2.0% Si, 0.5-3.0% Mn by mass, and the reminder being Fe and inevitable impurities, a size D2 of ferrite grain at a quarter region of sheet thickness from the surfaces of the hot-rolled sheet being less than 2.0 μm, the relation among the size D2 of ferrite grain, a size D3 of ferrite grain at a central region of sheet thickness from the surfaces of the hot-rolled sheet, and a size D1 of ferrite grain at a position 50 μm in depth of sheet thickness from the surfaces of the hot-rolled sheet satisfying the expression:

$$(D3-D1)/D2 \leq 0.4, \text{ and}$$

a grain size Dr in the rolling direction and a grain size Dt in the thickness direction of the ferrite grain at a position 50 μm in depth of sheet thickness from the surfaces of the hot-rolled sheet satisfying the expression (1)

$$|(Dr-Dt)/((Dr+Dt)/2)| \leq 0.25 \quad (1).$$

* * * * *